US005464129A

United States Patent [19]

Ho

[11] Patent Number: 5,464,129

[45] Date of Patent: Nov. 7, 1995

[54] PUMP SPRAY BOTTLE

[76] Inventor: Richard K. Ho, P.O. Box 15925, Honolulu, Hi. 96830-5925

[21] Appl. No.: 249,337

[22] Filed: May 27, 1994

[51] Int. Cl.[6] ..... B67D 5/60

[52] U.S. Cl. ..... 222/377; 222/382; 222/464.7

[58] Field of Search ..... 222/211, 377, 222/382, 464, 383

[56] References Cited

U.S. PATENT DOCUMENTS

| | | | |
|---|---|---|---|
| 847,760 | 3/1907 | Gates | 222/382 X |
| 1,339,237 | 5/1920 | Thompson | 222/382 X |
| 1,995,098 | 3/1935 | Healy | 222/464 X |
| 2,002,635 | 5/1935 | Kinney | 222/211 X |
| 3,339,811 | 9/1967 | Haag | 222/464 X |
| 4,470,526 | 9/1984 | Cha et al. | 222/382 X |
| 4,969,585 | 11/1990 | Hester | 222/464 X |
| 4,972,973 | 11/1990 | Davis | 222/464 X |
| 5,062,549 | 11/1991 | Smith et al. | 222/464 X |

FOREIGN PATENT DOCUMENTS

| | | | |
|---|---|---|---|
| 3829962 | 5/1989 | Germany | 222/464 |

*Primary Examiner*—Andres Kashnikow
*Assistant Examiner*—Kenneth R. DeRosa
*Attorney, Agent, or Firm*—Michael I. Kroll

[57] ABSTRACT

An improved pump spray bottle comprising a container for holding liquid therein. A pump head is on the container. A dip tube is coupled to the pump head. A structure is within the container for completely removing all of the liquid from within the container through the dip tube and out of the pump head.

5 Claims, 2 Drawing Sheets

PUMP SPRAY BOTTLE

BACKGROUND OF THE INVENTION

The instant invention is the subject matter of Disclosure Document No.: 345866, filed in the PTO on Jan. 10, 1994, and it is respectfully requested that this document be retained beyond the two-year period so that it may be relied upon as evidence of conception of the invention during the prosecution phase of this application, should the need arise.

1. Field of the Invention

The instant invention relates generally to dispenser bottles and more specifically it relates to an improved pump spray bottle.

2. Description of the Prior Art

Numerous dispenser bottles have been provided in prior art that are adapted to allow their liquid contents to be taken out and used in convenient or prescribed amounts. While these units may be suitable for the particular purpose to which they address, they would not be as suitable for the purposes of the present invention as heretofore described.

SUMMARY OF THE INVENTION

A primary object of the present invention is to provide an improved pump spray bottle that will overcome the shortcomings of the prior art devices.

Another object is to provide an improved pump spray bottle in which a tapered base of a container is sloped, so that the liquid contents in the container will flow towards a mouth end of a dip tube located at one side wall of the container.

An additional object is to provide an improved pump spray bottle in which the dip tube is either held to the side wall by C-clamps or in a channel built directly into the side wall, so that the mouth end of the dip tube will be located directly at a lower side of the tapered base to completely remove all of the liquid from within the container.

A further object is to provide an improved pump spray bottle that is simple and easy to use.

A still further object is to provide an improved pump spray bottle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
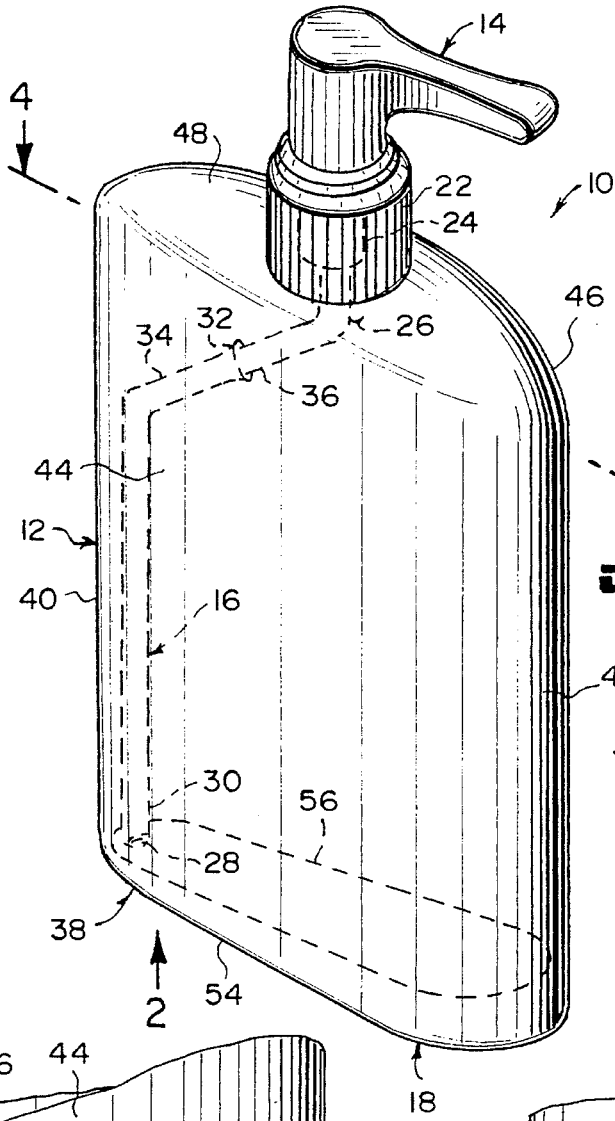
FIG. 1 is a top perspective view of a first embodiment of the instant invention.

Turning now descriptively to the drawings, in which similar reference characters denote similar elements throughout the several views, FIGS. 1 through 6 illustrate an improved pump spray bottle 10 comprising a container 12 for holding liquid therein. A pump head 14 is on the container 12. A dip tube 16 is coupled to the pump head 14. A structure 18 is within the container 12, for completely removing all of the liquid from within the container 12 through the dip tube 16 and out of the pump head 14.

The container 12 has an externally threaded neck 20. The pump head 14 has an internally threaded cap 22 to engage with the externally threaded neck 20 of the container 12. The pump head 14 includes an accumulator 24 built into the cap 22 and a pipe 26 extending from the accumulator 24.

The dip tube 16 includes a mouth 28 formed on a lower end 30. A funnel 32 formed on an upper end 34 to receive a free end 36 of the pipe 26 from the accumulator 24.

The container 12 includes a bottom wall 38, a pair of side walls 40 and 42, a front wall 44, a rear wall 46 and a top wall 48 maintaining the externally threaded neck 20.

The liquid removing structure 18 consists of the bottom wall 38 of the container 12 being tapered. A component 50 is for maintaining the dip tube 16 at the first side wall 40 of the container 12 at the lowest end of the tapered bottom wall 38. The mouth 28 on the lower end 30 of the dip tube 16 will be located right at the lowest end of the tapered bottom wall 38, to receive all of the liquid held within the container 12.

The tapered bottom wall 38, the side walls 40, 42, the front wall 44, the rear wall 46 and the top wall 48 are all integral and fabricated out of durable material 52, such as plastic or the like.

The tapered bottom wall 38 includes a horizontal bottom surface 54 a sloped top surface 56 angled downwards towards the mouth 28 of the dip tube 16. The lowest end of the tapered bottom wall 38 which is narrower than the opposite end is located at the mouth 28 of the dip tube 16.

Figure 2:
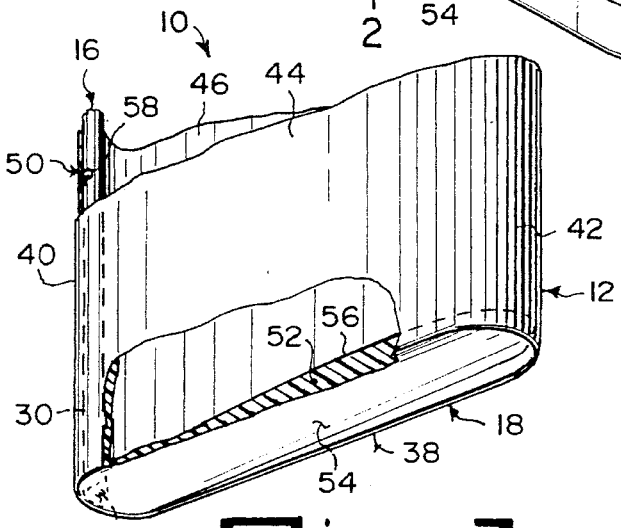
FIG. 2 is a bottom perspective view taken in the direction of arrow 2 in FIG. 1, with parts broken away and in section.
Figure 3:
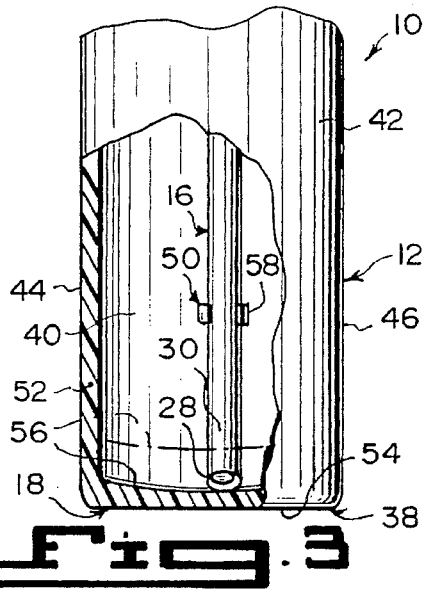
FIG. 3 is a side view taken in the direction of arrow 3 in FIG. 1, with parts broken away and in section.
Figure 4:
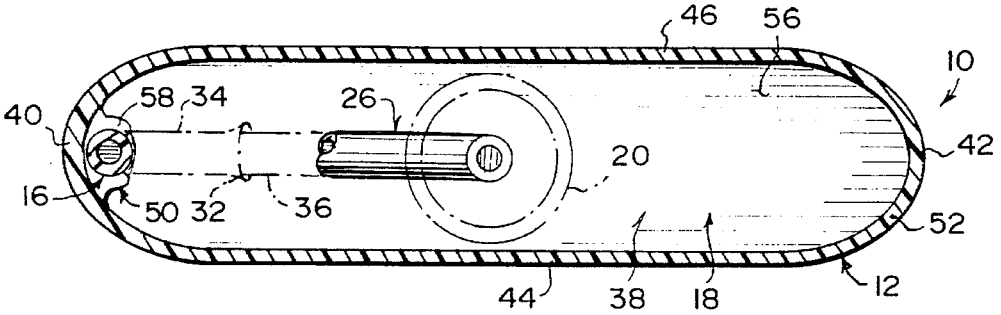
FIG. 4 is a cross sectional view taken along line 4—4 in FIG. 1.
Figure 6:
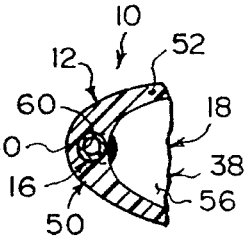
FIG. 6 is a cross sectional view taken along line 6—6 in FIG. 5 through the built-in dip tube.
Figure 5:
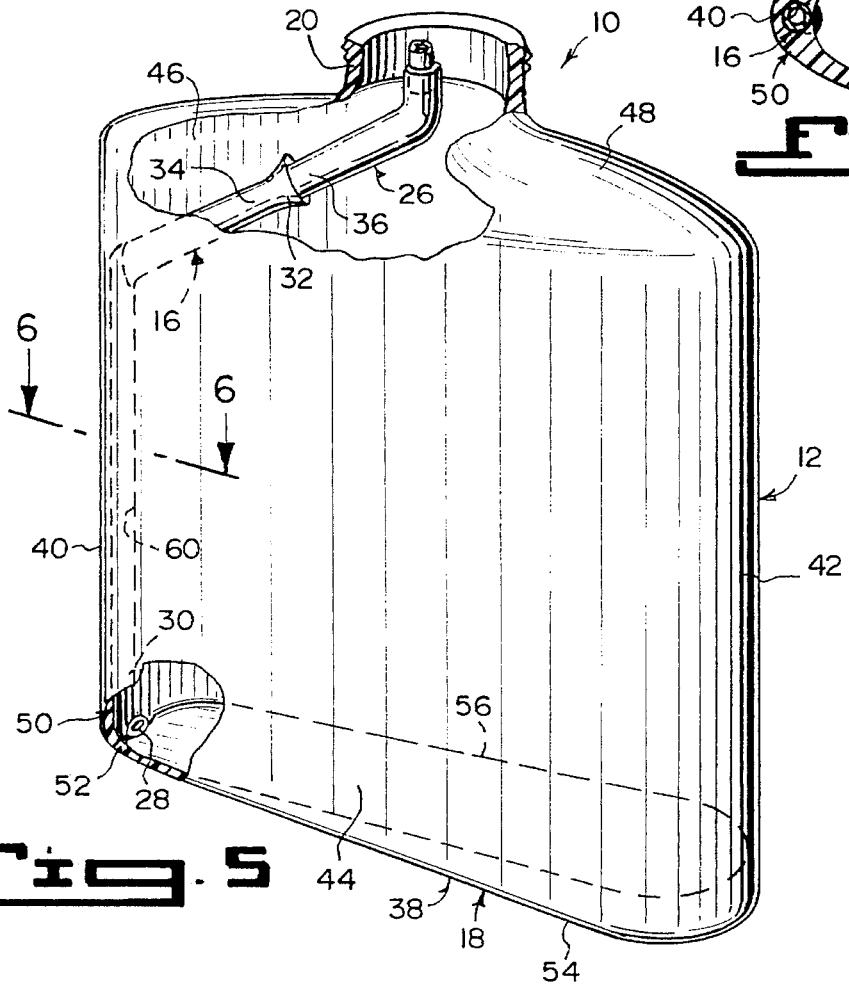
FIG. 5 is a top perspective view of a second embodiment of the instant invention with parts broken away and in section.

The dip tube maintaining component 50, as shown in FIGS. 2, 3 and 4, is a C-clamp member 58 affixed to said first side wall 40 of the container 12 to hold the dip tube 16 in a generally parallel position to the first side wall 40. The dip tube maintaining component 50, as shown in FIGS. 5 and 6, is a channel 60 built directly into the first side wall 40 of the container 12, to hold the dip tube 16 in a generally parallel position to the first side wall 40.

OPERATION OF THE INVENTION

To use the improved pump spray bottle 10, the following steps should be taken:

1. Remove the cap 22 of the pump head 14 from the neck 20 of the container 12.
2. Fill the container 12 with liquid to be dispensed therefrom.
3. Replace the cap 22 of the pump head 14 back onto the neck 20 of the container 12.
4. Press the pump head 14 up and down, so that the accumulator 24 can suck up the liquid through the pipe 26 from the mouth 28 on the lower end 30 of the dip tube 16, which is located on the first side wall 40 at the lower end of the tapered bottom wall 38 in the container 12.

5. Repeat step 4 many times, until all of the liquid is removed from the container 12.

LIST OF REFERENCE NUMBERS

10 improved pump spray bottle
12 container
14 pump head
16 dip tube
18 liquid removing structure
20 externally threaded neck of 12
22 internally threaded cap of 14
24 accumulator in 14
26 pipe from 24
28 mouth on 30
30 lower end of 16
32 funnel on 34
34 upper end of 16
36 free end of 26
38 tapered bottom wall of 12
40 first side wall of 12
42 second side wall of 12
44 front wall of 12
46 rear wall of 12
48 top wall of 12
50 dip tube maintaining component
52 durable material
54 horizontal bottom surface of 38
56 sloped top surface of 38
58 C-clamp member on 40 for 50
60 channel in 40 for 50

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A pump spray bottle comprising:

a) a container for holding liquid therein, said container having an externally threaded neck;

b) a pump head on said container, said pump head having an internally threaded cap to engage with said externally threaded neck of said container, said pump head including an accumulator built into said and a pipe extending from said accumulator;

c) a dip tube coupled to said pump head, said dip tube including a mouth formed on a lower end, and a funnel formed on an upper end to receive a free end of said pipe from said accumulator; and d) means within said container for completely removing all of the liquid from within said container through said dip tube and out of said pump head, said container including a bottom wall, a first side wall and a second side wall, a front wall, a rear wall, and a top wall maintaining said externally threaded neck, said liquid removing means including said bottom wall of said container being tapered, and means for maintaining said dip tube at said first side wall of said container at the lowest end of said tapered bottom wall, so that said mouth on the lower end of said dip tube will be located right at the lowest end of said tapered bottom wall to receive all of the liquid held within said container.

2. A pump spray bottle as recited in claim 1, wherein said tapered bottom wall, said side walls, said front wall, said rear wall and said top wall are all integral and fabricated out of durable material.

3. A pump spray bottle as recited in claim 2, wherein said tapered bottom wall includes:

a) a horizontal bottom surface; and b) a sloped top surface angled downwards towards said mouth of said dip tube, so that the lowest end of said tapered bottom wall, which is narrower than the opposite end is located at said mouth of said dip tube.

4. A pump spray bottle as recited in claim 3, wherein said dip tube maintaining means is a C-clamp member affixed to said first side wall of said container to hold said dip tube in a generally parallel position to said first side wall.

5. A pump spray bottle as recited in claim 3, wherein said dip tube maintaining means is a channel built directly into said first side wall of said container to hold said dip tube in a generally parallel position to said first side wall.

* * * * *